United States Patent [19]

Sarazen, Jr. et al.

[11] Patent Number: 4,821,628

[45] Date of Patent: Apr. 18, 1989

[54] SHALLOW-PROFILE FOUNDATION VENTILATOR

[76] Inventors: Paul M. Sarazen, Jr., 214 Fairview Dr.; Dennis A. Beam, Jr., 410 Westfield Dr., both of Shelby, N.C. 28150

[21] Appl. No.: 145,627

[22] Filed: Jan. 19, 1988

[51] Int. Cl.[4] ..... F24F 7/00

[52] U.S. Cl. ..... 98/29; 98/37; 98/118

[58] Field of Search ..... 49/463, 465, 466; 98/29, 37, 41.3, 99.8, 114, 119, 118

[56] References Cited

U.S. PATENT DOCUMENTS

| | | | |
|---|---|---|---|
| 2,525,371 | 10/1950 | Reynolds, Sr. | 98/29 |
| 2,821,895 | 2/1958 | Allabaugrl | 98/29 |
| 4,210,279 | 7/1980 | McSwain | 236/49 |
| 4,231,514 | 11/1980 | McSwain | 236/49 |
| 4,249,460 | 2/1981 | McSwain | 98/32 |
| 4,493,456 | 1/1985 | Sarazen, Jr. et al. | 236/49 |
| 4,502,368 | 3/1958 | Hempel | 98/29 |
| 4,587,892 | 5/1986 | Witten et al. | 98/29 |
| 4,669,371 | 6/1987 | Sarazen, Jr. et al. | 98/29 |
| 4,676,145 | 6/1987 | Allred | 98/29 |

FOREIGN PATENT DOCUMENTS

| | | | |
|---|---|---|---|
| 1167245 | 11/1958 | France | 98/114 |

*Primary Examiner*—Harold Joyce

*Attorney, Agent, or Firm*—Dority & Manning

[57] ABSTRACT

A shallow-profile foundation ventilator includes a body with at least one vent opening extending therethrough and covered by a screen. A skirt is connected to the body and extends perpendicularly from the body's back surface. Installation clips are attached to left and right portions of the skirt. An installation member at one end of the clip extends a short distance into the foundation opening and is biased against the opening by a resilient intermediate portion of the clip. In one embodiment, the ventilator includes a flat cover plate dimensioned to cover each vent opening. The cover plate defines a plurality of tear-drop openings disposed around the outer edge for receiving a plurality of attachment pegs extending generally normally from the back surface of the body. The tear-drop openings are disposed to engage the attachment pegs to secure the cover plate to the ventilator's back surface. In another embodiment, a cover member-defines at least one open portion and one closed portion, each open portion being configured to correspond to a vent opening in the body. Two oppositely disposed sliding edges of the cover member slide in a pair of tracks attached to the ventilator body. A knob attached to the cover member extends therefrom and through a control slot defined through the body whereby movement of the knob within the control slot varies the degree to which the cover member covers each vent opening.

13 Claims, 3 Drawing Sheets

SHALLOW-PROFILE FOUNDATION VENTILATOR

BACKGROUND OF THE INVENTION

The present invention relates to ventilators for installation in openings formed in the foundation of a dwelling or other building structure. In particular, the present invention relates to a shallow-profile foundation ventilator that is especially suited for applications requiring a replacement or retrofit ventilator.

Conventional shallow-profile ventilators are installed as original equipment during construction of a house or other building and are sometimes known as "primary" ventilators to indicate that they are part of the original building structure. Such primary ventilators typically have projections, sometimes referred to as "lintels," extending from the top of the ventilator. The projections rest on top of a course of brick and are sandwiched between another course of brick placed on top of the projections. Thus, conventional shallow-profile ventilators require mortar for their installation and are not suitable for most replacement or retrofit applications. Accordingly, conventional shallow-profile ventilators are best suited for primary use, and either require mortar for installation or have integral lintels, which make retrofit use impossible.

One type of a conventional retrofit foundation ventilator typically has a body including a front flange which rests against the outside-facing perimeter of the foundation opening. Such conventional retrofit ventilators also typically have a body, the depth of which extends a significant distance from the flange into the installation opening. U.S. Pat. No. 4,587,892 discloses an example of such type of a typical replacement or retrofit foundation ventilator which includes a peripheral flange 16 and an inner portion of the mounting frame broadly indicated at 30. Additional examples of such conventional retrofit foundation ventilators include those shown in U.S. Pat. Nos. 4,210,279 and 4,493,456.

The above-described conventional foundation ventilator configuration presents significant installation problems for certain kinds of foundation openings. A large number of dwellings and other building structures have been refurbished by the installation of wood shingling, aluminum siding or vinyl siding over the original outside finish of the structure. The installation of the siding often results in foundation openings which are partially covered by overhanging siding. This reduces the exterior size of the foundation opening and renders installation of conventional foundation ventilators such as those described above, difficult or impossible. This is because in many instances, the combination of the peripheral flange and the depth of the housing produces a shape which cannot be manuevered into the opening for installation. Cutting away the overhanging portion of the siding results in an aesthetically displeasing appearance of the siding where portions are cut away to permit installation of a conventional foundation ventilator.

In other cases, foundation openings are already fitted with a grille or ventilator structure that is recessed a short distance from the front of the foundation opening. Such grilles or ventilators lack the kind of peripheral flange of the conventional ventilators described above. However, removal of these so-called "recessed" grilles or ventilator structures often requires much effort and difficulty due to rusting or encrustation of mortar or cement around the structure.

Another type of ventilator has an intermediate depth profile which requires about twice the depth clearance in the foundation opening as a shallow depth profile ventilator, but less opening depth clearance than a conventional retrofit foundation ventilator such as described above. Examples of so-called intermediate depth ventilators include U.S. Pat. Nos. 4,231,514 and 4,249,460. One reason for the additional opening clearance required by such intermediate depth ventilators is the need to permit the opening mechanism to expand backward into the foundation opening. In U.S. Pat. No. 4,231,514 for example, movable louver panels 40, 42 (FIG. 3) move away from the ventilator body 10 and toward the back of the foundation opening as the ventilator opens to admit more air therethrough (column 4, lines 42–63). If such intermediate depth ventilators are to be used as replacement ventilators, removal of the original ventilator or grille is required. Moreover, such intermediate depth ventilators require mortar for their installation.

OBJECTS AND SUMMARY OF THE INVENTION

It is a principal object of the present invention to provide an improved foundation ventilator suitable for mounting in foundation openings which have been partially covered by siding.

It also is a principal object of the present invention to provide an improved foundation ventilator for mounting in foundation openings which previously have been fitted with a grille or ventilator structure that is recessed at least a short distance from the front of the foundation opening, without removing the old grille or ventilator structure.

Another object of the present invention is to provide an improved foundation ventilator structure that has a sufficiently shallow depth profile to facilitate installation into a foundation opening which has been partially covered by siding.

A further object of the present invention is to provide a shallow depth profile foundation ventilator assembly having a means for opening and closing the ventilator to control ingress and egress of ventilating air through the ventilator.

Still another object of the present invention is to provide an improved foundation ventilator structure in which the means for installing same into a foundation opening which has been partially covered by siding, is adjustable to facilitate installation of the ventilator structure and does not require the use of mortar.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects, and in accordance with the purpose of the invention, as embodied and broadly described herein, the shallow-profile foundation ventilator of this invention comprises a body. The body defines a front surface, a back surface, and at least one vent opening extending through the body from the front surface to the back surface. The ventilator further includes means for screening matter that is larger than a predetermined size from passing through each of the vent openings. The ventilator also includes means for defining a depth dimension of the body, and this depth dimension definition means is connected to the back surface of the body and extends generally normally from the back surface. The ventilator further includes means for securing the ventilator to the installation opening for which the ventilator is intended. The installation securing means has at least one installation member for extending into the installation opening. Each installation member extends beyond the depth dimension definition means of the ventilator and extends generally normally from the body of the ventilator. In addition, the ventilator includes means for covering each vent opening and means for controlling the degree to which each vent opening is covered by the covering means.

The means for securing the ventilator to the installation opening preferably comprises at least two installation clips, each clip defining an installation member at one end thereof and defining at another end thereof means for attaching the installation clip to the depth dimension definition means. The means for attaching the installation clip to the depth dimension means preferably includes an opposed pair of flanges resiliently biased toward one another and having at least one boss on each flange, each boss facing toward the other flange. The installation clip further preferably defines a resilient intermediate portion for biasing the installation member against the surface of the opening in the foundation. The resilient intermediate portion is connected to one end of the installation member and also to the portion of the installation clip carrying the opposed pair of resiliently biased flanges.

The depth dimension definition means preferably comprises a skirt connected to the body around the outer periphery of the body. The outer periphery of the body can be defined by a perimeter which includes a top perimeter, a bottom perimeter, a right perimeter, and a left perimeter. The perimeter also can be disposed on the body away from the outer periphery of the body.

One preferred embodiment of the means for covering each of the vent openings includes a flat cover plate that is dimensioned for covering each of the vent openings. The cover plate preferably defines a plurality of tear-drop shaped openings through the cover plate. The tear-drop shaped openings preferably are disposed near the outer edge of the cover plate and symmetrically about the outer edge thereof. The covering means further includes a plurality of attachment pegs extending normally from the back surface of the body and disposed generally surrounding the portion of the body which defines all of the vent openings. Each peg is disposed to coincide with one of the tear-drop openings of the cover plate. The teardrop openings of the cover plate engage respective coincident ones of the attachment pegs to secure the cover plate to the body and against the back surface of the body and thereby cover all of the vent openings with the cover plate.

Another preferred embodiment of the means for covering each of the vent openings includes a cover member which defines at least one open portion through the cover member and at least one closed portion. Each of the open portions is configured to correspond to at least one of the vent openings of the body. A pair of edges are disposed opposite one another at the periphery of the cover member and are configured to engage with a track for sliding engagement with the track. This covering means embodiment further includes a pair of tracks disposed on and attached to the back surface of the body and disposed opposite one another for receiving the edges of the cover member in sliding engagement therewith. The cover member is slidable as the sliding edges thereof slide within the tracks to cover each of the vent openings. The degree to which the vent openings are covered can be varied by the degree to which the cover member is moved in sliding engagement between the pair of tracks.

In the latter embodiment of the covering means, means are provided for controlling the degree of covering each of the vent openings. The means for controlling the degree of covering each of the vent openings preferably includes a control slot defined through the body. The controlling means further includes a knob attached to the cover member and extending from the cover member through the control slot. Grasping the knob and moving same within the control slot varies the degree to which the cover member covers each of the vent openings in accordance with the degree to which the knob is moved within the control slot.

The screening means preferably comprises a screen that is secured around the periphery of the screen to the back surface of the body. The screen extends completely across each of the vent openings.

The front surface of the body preferably is decoratively contoured so as to appear aesthetically pleasing.

The accompanying drawings, which are incorporated in and constitute a part of this specification, illustrate embodiments of the invention and together with the description serve to explain the principles of the invention.

DESCRIPTION OF THE PREFERRED EMBODIMENTS

Figure 1:
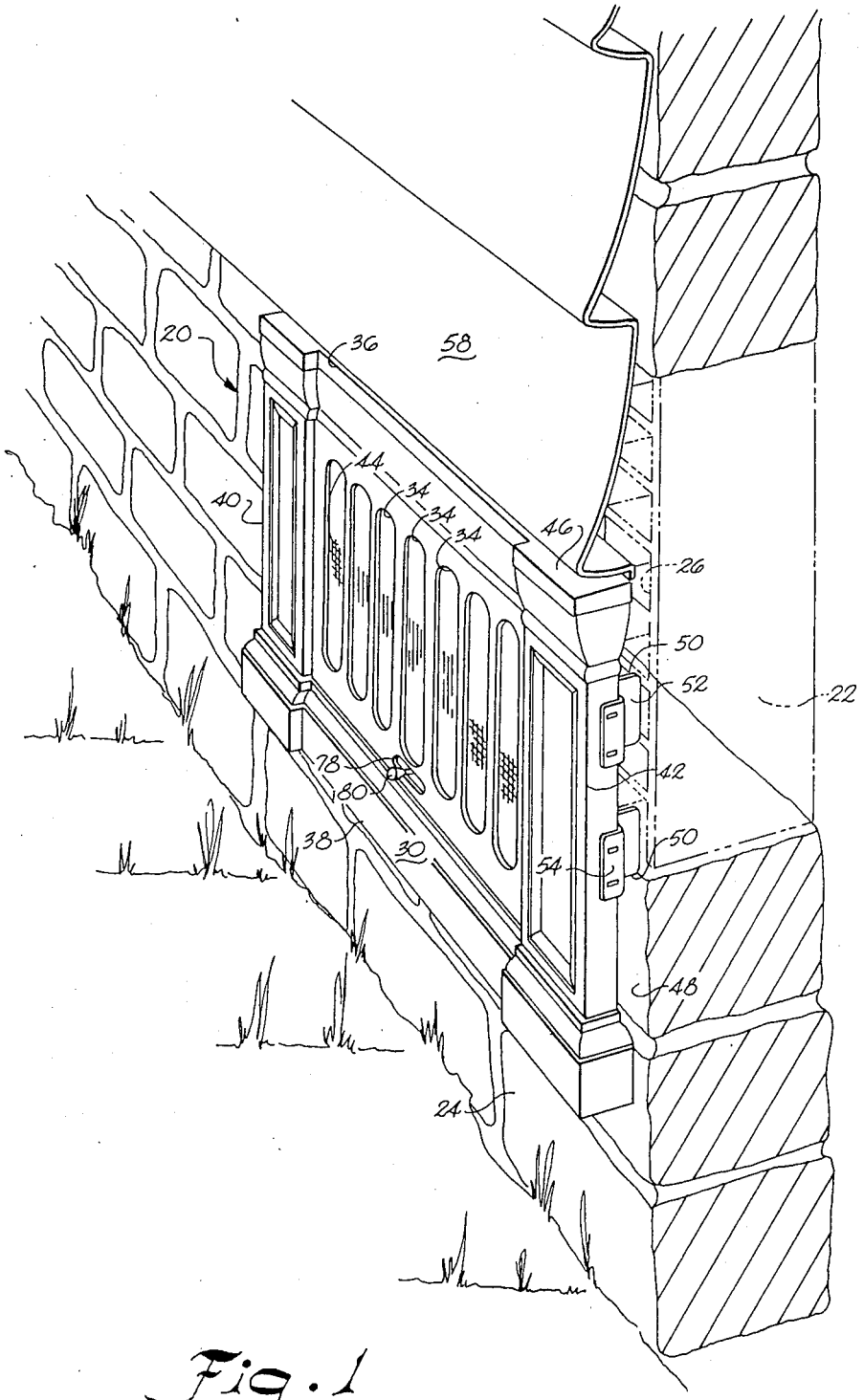
FIG. 1 is a perspective plan view of an embodiment of the present invention.

Reference now will be made in detail to the present preferred embodiments of the invention, examples of which are illustrated in the accompanying drawings. A preferred embodiment of the present invention is illustrated in FIG. 1 and designated generally by the numeral 20. A shallow-profile foundation ventilator 20 for being installed into an installation opening 22, also referred to as a foundation opening 22, of a foundation 24 is illustrated in FIG. 1. Installation opening 22 is defined by an installation opening surface 26 around the boundary thereof.

Figure 2A:
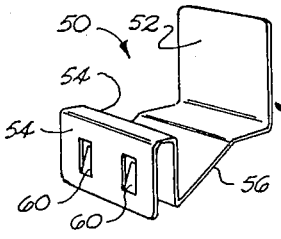
FIG. 2*a* is a perspective view of a component of an embodiment of the present invention.
Figure 2:
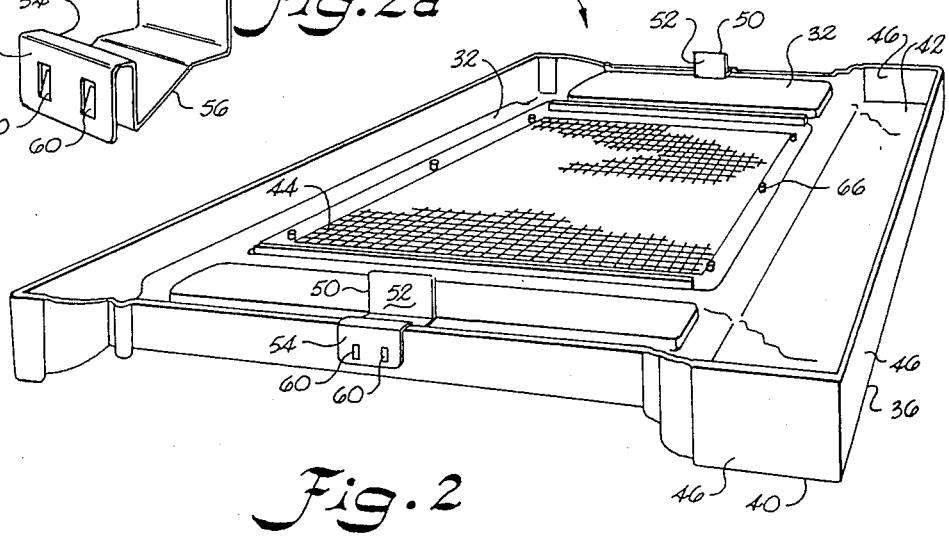
FIG. 2 is a perspective plan view of an embodiment of the present invention.

The ventilator of the present invention includes a body which is generally designated in FIG. 2 by the numeral 28. Body 28 defines a front surface 30 shown in FIG. 1 for example. Body 28 also defines a back surface 32 shown in FIGS. 2, 3, and 4 for example.

Figure 6:
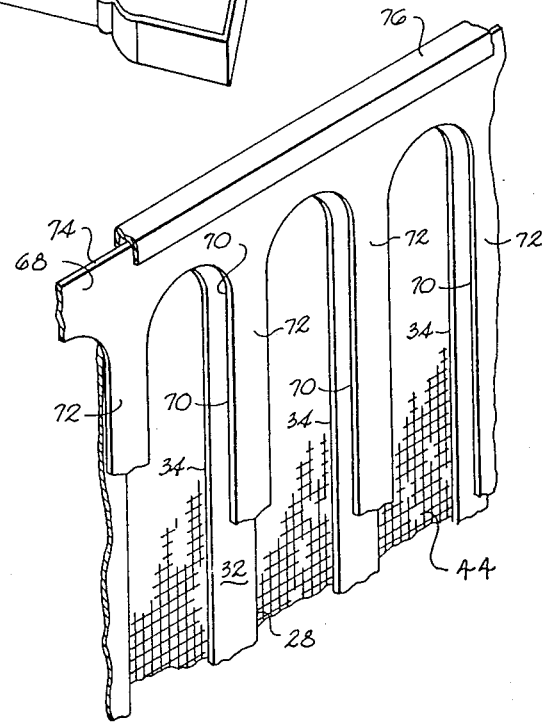
FIG. 6 is a partial view of components of an embodiment of the present invention shown in FIG. 4.

As shown in FIGS. 1 and 6 for example, body 28 defines at least one vent opening 34 extending through the body from the front surface to the back surface. Preferably, a plurality of vent openings 34 are defined in body 28. As shown in FIG. 1 for example, body 28 further defines a perimeter which consists of a top perimeter 36, a bottom perimeter 38, a left perimeter 40, and a right perimeter 42. The perimeter of body 28 essentially defines a boundary of body 28. This perimeter can define the extreme edge of body 28 or it can be defined at a portion of body 28 away from the extreme edge thereof.

In accordance with the present invention, means are provided for screening matter larger than a predetermined size from passing through each vent opening. This provides a means for screening insects and air borne particulates larger than a predetermined size from passing through each vent opening. As embodied herein and shown for example in FIGS. 1, 2, and 6, the screening means preferably comprises a screen mesh 44 that is secured around the periphery of the screen to back surface 32 of body 28. Screen 44 can be formed of metal or synthetic fiber, such as nylon, and extends completely across each of vent openings 34 defined through body 28.

In accordance with the present invention, there is provided means for defining a depth dimension of the body. As embodied herein and shown for example in FIGS. 1, 2, 3, 4, and 5, the depth dimension definition means preferably includes a skirt 46 connected to body 28 at the perimeter of body 28. As shown in FIG. 1, skirt 46, or at least a portion thereof, rests against a front surface 48 of foundation 24 when ventilator 20 is installed into installation opening 22.

Like the perimeter of body 28, skirt 46 need not be located at the extreme outer edge of body 28. In some embodiments (not shown), skirt 46 can be defined away from the outer most edge of body 28.

In further accordance with the present invention, means are provided for securing the ventilator to the installation opening. As embodied herein and shown for example in FIGS. 1 and 2, the means for securing the ventilator to the installation opening preferably comprises an installation clip 50. Installation clip 50 includes at least one installation member 52 which extends into installation opening 22 when ventilator 20 is installed into installation opening 22. As shown in FIGS. 1 and 2 for example, installation member 52 extends beyond skirt 46 and extends in a direction generally normally from body 28 of ventilator 20.

As shown in FIG. 2*a*, installation clip 50 defines means for attaching the installation clip to the depth dimension definition means, herein embodied as skirt 46. As embodied herein and shown for example in FIG. 2*a*, the means for attaching the installation clip to the depth dimension definition means includes an opposed pair of flanges 54 which are resiliently biased toward one another. The means for attaching the installation clip to the depth dimension definition means further includes at least one boss 60 defined in at least one flange 54. Each boss 60 extends towards the opposing flange. As shown in FIGS. 2 and 2*a* for example, bosses 60 apply pressure against skirt 46 to secure clip 50 to skirt 46. However, the exertion of a sufficient amount of force can effectively remove clip 50, once the pressure exerted by bosses 60 is overcome. Thus, installation clips 50 are removably attachable along the depth dimension definition means embodied by skirt 46.

Preferably, installation clip 50 is formed of a unitary piece of resilient metal such as spring steel. As shown in FIG. 2*a*, installation clip 50 further defines a resilient intermediate portion 56 which biases installation member 52 against installation opening surface 26 of foundation opening 24. Intermediate portion 56 is connected at one end to installation member 52 and at the other end to flanges 54. Intermediate portion 56 preferably is bowed as shown in FIG. 2*a* to provide the necessary resiliency and spring-like force to effectively engage installation clip 50 pressed against installation opening surface 26 of foundation opening 22.

Preferably, four installation clips 50 are employed when installing ventilator 20 into foundation opening 22. Two installation clips 50 preferably are disposed on skirt 46 extending from right perimeter 42 as shown in FIG. 1, and two more installation clips 50 (not shown) are disposed on skirt 46 at left perimeter 40.

Moreover, as can readily be seen by reference to FIG. 1, installation clips 50 can be inserted at any desired location along skirt 46 to adjust to different size openings 22 depending upon the extent to which siding 58 extends to partially cover foundation opening 22. In this manner, the means for securing the ventilator to the installation opening is adjustable to accommodate different size openings. The size of such openings varies according to how much of the opening is obscured by siding 58.

Furthermore, only installation member 52 of installation clip 50 is required to extend past the edge defined by skirt 46 into the installation opening. This minimal requirement maintains the shallow depth profile of the ventilator and facilitates installation in foundation openings of the kind shown in FIG. 1. This feature also permits the ventilator of the present invention to be used in installation openings in which an old ventilator remains installed but is recessed a small distance from the front surface of the foundation. This eliminates the need for the owner of the dwelling to remove the old ventilator before being able to install a replacement device. Thus, the present invention can be used as a replacement ventilator in circumstances which would prevent use of a conventional retrofit ventilator without first removing the old ventilator from the foundation opening or in circumstances which would prevent use of a conventional primary shallow-profile ventilator without using mortar.

In still further accordance with the present invention, there is provided means for covering each of the vent openings defined in the body of the ventilator. As embodied herein and shown for example in FIGS. 3 and 3*a*, the means for covering each vent opening include a flat cover plate 62 which is dimensioned for covering each vent opening 34. Cover plate 62 defines a plurality of tear-drop shaped openings 64 therethrough. Tear-drop shaped openings 64 are disposed near the outer edge of cover plate 62. Moveover, as shown in FIG. 3 for example, the narrow portions of all of tear-drop shaped openings 64 defined in cover plate 62 preferably all point in the same direction.

Figure 3A:
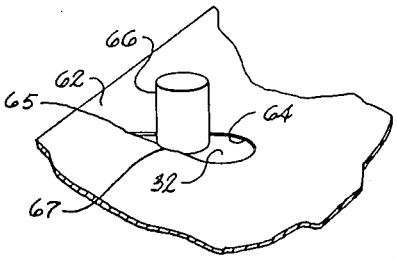
FIG. 3*a* is a partial perspective view of components of an embodiment of the present invention shown in FIG. 3.
Figure 3:
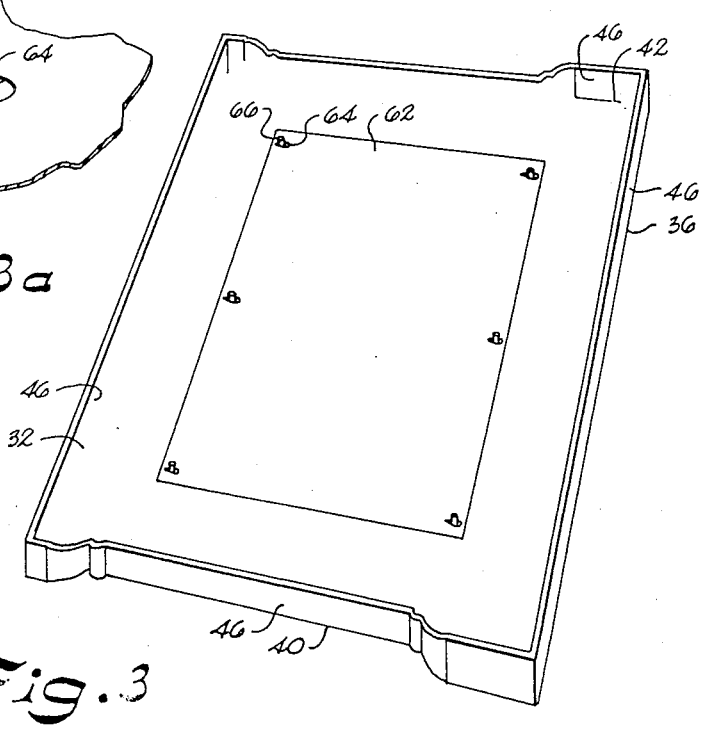
FIG. 3 is another perspective plan view of an embodiment of the present invention.

The embodiment of the cover means shown in FIGS. 3 and 3*a* further includes a plurality of attachment pegs 66 which extend generally normally from back surface 32 of body 28. Attachment pegs 66 preferably are disposed generally surrounding the portion of body 28 which defines all of vent openings 34. Each peg 66 preferably is disposed to coincide with one of tear-drop shaped openings 64 of cover plate 62. In operation, cover plate 62 is positioned so that its tear-drop shaped openings 64 are aligned with coincident attachment pegs 66 of back surface 32. Then cover plate 62 is lowered onto back surface 32 while attachment pegs 66 are permitted to pass through the widest portion of tear-drop shaped openings 64. To secure cover plate 62 to back surface 32 of body 28, cover plate 62 is moved in a direction opposite to the direction in which the acute ends 65 (FIG. 3*a*) of teardrop shaped openings 64 are pointing. This movement engages the narrow portions 67 of tear-drop shaped openings 64 against attachment pegs 66. Preferably, attachment pegs 66 are formed of a plastic or other material deformable by the narrow portions of tear-drop shaped openings 64. Preferably, body 28 of ventilator 20 is formed of a plastic material that has been molded as a unitary construction including attachment pegs 66 and skirt 46.

Figure 4:
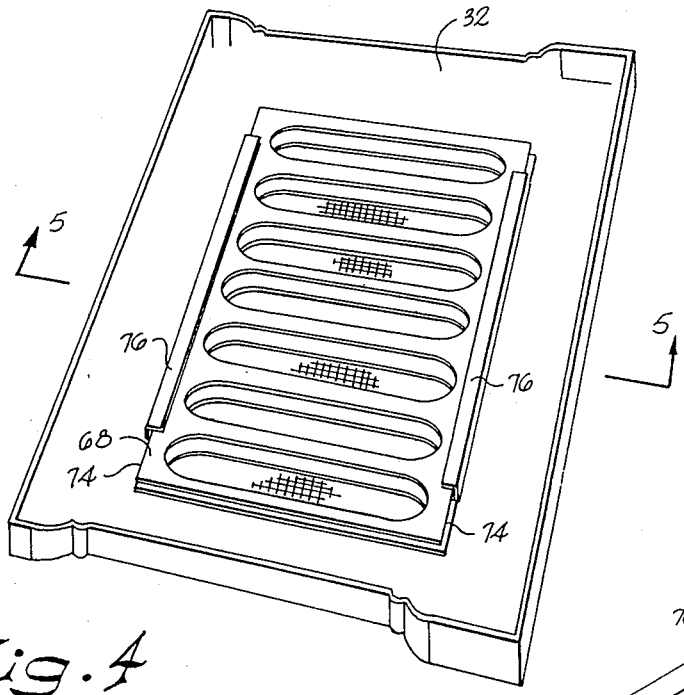
FIG. 4 is a perspective plan view of an embodiment of the present invention.
Figure 5:
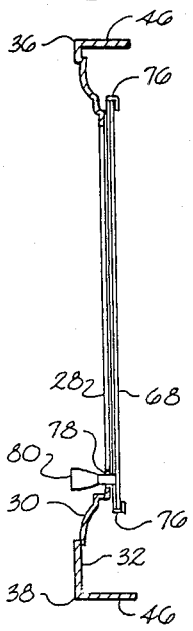
FIG. 5 is a cross-sectional view of the embodiment shown in FIG. 4 and taken along the lines 5—5.

As embodied herein and shown for example in FIGS. 1, 4, 5, and 6, another preferred embodiment of the means for covering each vent opening includes a cover member 68 which defines at least one open portion 70 and at least one closed portion 72. Each open portion 70 is defined through cover member 68 and is configured to correspond to at least one vent opening 34 of body 28. As shown in FIGS. 4 and 6, cover member 68 further defines at the periphery thereof two oppositely disposed sliding edges 74 for sliding engagement with a pair of tracks 76 which are disposed on and attached to back surface 32 of body 28.

Tracks 76 can be formed as an integral part of a structure which includes an attachment plate 75 for attaching tracks 76 to back surface 32 of body 28. Attachment plate 75 is configured identically as cover member 69 with open and closed portions, and the open portions coincide with vent openings 34 in body 28. Preferably, screen 44 is held between back surface 32 and attachment plate 75 as attachment plate 75 is attached to back surface 32. A track 76 is formed at each of two oppositely disposed edges of attachment plate 75. In another embodiment, each track 76 constitutes a separate structure attached to back surface 32 of body 28. In both embodiments, tracks 76 are disposed in opposition to one another for receiving sliding edges 74 in sliding engagement with tracks 76. Cover member 68 is slidable within tracks 76 to cover each vent opening 34 to varying degrees as edges 74 of cover member 68 are moved in sliding engagement within tracks 76.

Regarding the covering means embodiment shown in FIGS. 1, 4, 5, and 6, there is provided means for controlling the degree of covering of each vent opening. As embodied herein and shown for example in FIGS. 1 and 5, the means for controlling the degree of covering each vent opening preferably includes a control slot 78 defined through body 28. The controlling means further preferably includes a knob 80 which is attached to cover member 68 and extends therefrom and through control slot 78. Typically, cover member 68 is molded of plastic and includes knob 80 as a unitary construction. However, knob 80 can be attached to cover member 68 as by a screw or by gluing or otherwise fusing knob 80 with cover member 68.

Movement of knob 80 within control slot 78 varies the degree to which cover member 68 covers each vent opening 34 with closed portion 72. For example, positioning knob 80 in the center of control slot 78 as shown in FIG. 1, can correspond to perfect coincidence of open portion 70 of cover member 68 and vent openings 34 of body 28. In such a configuration, movement of knob 80 to the left would partially cover vent openings 34 with closed portion 72 of cover member 68. Similarly, moving knob 80 to the right, would partially cover the oppositely disposed portions of vent openings 34 by adjacent closed portions 72 of cover member 68. Moreover, different configurations can be formed so that for example movement of knob 80 to the extreme left corresponds to a completely open condition, and movement of knob 80 to the extreme right corresponds to a completely closed condition for ventilator 20.

As shown in FIG. 1, ventilator 20 is provided with a decoratively contoured front surface and skirt to provide an aesthetically pleasing appearance where once an unsightly foundation opening existed. Furthermore, ventilator 20 of the present invention can be used to cover a previously installed ventilator which resides completely within foundation opening 22 and has become either non-functional or unsightly. This is because the shallow-profile ventilator of the present invention does not need to have a substantial portion of any of its structure inserted into foundation opening 22 for purposes of installation. This is a significant difference over conventional retrofit foundation ventilators and a significant advantage of the present invention. This advantage increases the applications for which the ventilator of the present invention is suited. Often, an old ventilator has rusted parts or is secured by cement or mortar and can be removed only with great difficulty and effort. Installation of a conventional deep profile ventilator would require the removal of the old non-functional or unsightly ventilator before installation of the conventional deep profile ventilator could be effected. The ventilator of the present invention does not require the homeowner or other customer to attempt to remove the prior ventilator structure from the foundation opening before installing the ventilator of the present invention.

A conventional shallow-profile ventilator can only be installed with mortar and often requires modification of the masonry which defines the foundation opening. Installation of the ventilator of the present invention does not require the user to modify the masonry defining the foundation opening and eliminates any need for mortar.

It will be apparent to those skilled in the art that various modifications and variations can be made in the shallow-profile foundation ventilator of the present invention without departing from the scope or spirit of the invention. Thus, it is intended that the present invention cover the modifications and variations of this invention provided they come within the scope of the appended claims and their equivalents.

What is claimed is:

1. A shallow-profile foundation ventilator for being installed into the installation opening of a foundation, the installation opening being defined by an installation opening surface, the ventilator comprising:

(a) a body;

(b) said body defining a front surface, a back surface, and further defining at least one vent opening extending therethrough;

(c) means for screening matter larger than a predetermined size from passing through each said vent opening;

(d) means for defining a depth dimension of said body, said depth dimension definition means being connected to said back surface of said body and extending generally normally from said back surface;

(e) means for securing the ventilator to the installation opening, said installation securing means having at least one installation member for extending into the installation opening, each said installation member extending beyond said depth dimension definition means and extending generally normally from said body;

(f) means for covering each said vent opening, said covering means including a flat cover plate dimensioned for covering each said vent opening;

(g) said cover plate defining a plurality of tear-drop shaped openings therethrough and disposed near the outer edge thereof;

(h) said body having a plurality of attachment pegs extending normally from said back surface of said body and disposed generally surrounding the portion of said body defining all of said vent openings, each said peg being disposed to coincide with one of said tear-drop openings of said cover plate; and (i) said tear-drop openings of said cover plate engaging respective coincident ones of said attachment pegs to secure said cover plate to said body and against said back surface of said body and covering all of said vent openings.

2. An apparatus as in claim 1, wherein said means for securing the ventilator to the installation opening comprises:

at least two installation clips, each said clip defining said installation member at one end thereof and defining at another end thereof means for attaching each said installation clip to said depth dimension definition means.

3. An apparatus as in claim 2, wherein:

said installation clips are removably attachable along said depth dimension definition means.

4. An apparatus as in claim 3, wherein:

said means for attaching said installation clip to said depth dimension definition means includes an opposed pair of flanges resiliently biased toward one another for receiving said depth dimension definition means therebetween.

5. An apparatus as in claim 4, further comprising:

at least one boss defined on at least one of said flanges for applying securing pressure to said depth dimension definition means to be received between said flanges.

6. An apparatus as in claim 4, wherein:

said installation clip defines a resilient intermediate portion for biasing said installation member against the installation opening surface in the foundation, said resilient intermediate portion being connected to one end of said installation member.

7. An apparatus as in claim 1, wherein:

said depth dimension definition means comprises a skirt connected to said body around the outer periphery of said body.

8. An apparatus as in claim 1, wherein:

said means for covering each said vent opening includes:

(a) a cover member defining at least one open portion and at least one closed portion, each said open portion being defined through said cover member and being configured to correspond to at least one vent opening of said body, said cover member further defining at the periphery thereof two oppositely disposed sliding edges for sliding engagement with a track;

(b) a pair of tracks disposed on and attached to said back surface of said body and in opposition to one another for receiving said sliding edges of said cover member in sliding engagement therewith; and (c) said cover member being slidable within said tracks to cover each said vent opening to varying degrees as said edges of said cover member are moved in sliding engagement between said pair of tracks.

9. An apparatus as in claim 8, further comprising:

(d) means for controlling the degree of covering each said vent opening.

10. An apparatus as in claim 9, wherein said means for controlling the degree of covering each said vent opening comprises:

(e) a control slot defined through said body;

(f) a knob attached to said cover member and extending therefrom and through said control slot; and (g) whereby movement of said knob within said control slot varies the degree to which said cover member covers each said vent opening.

11. An apparatus as in claim 1, wherein:

said screening means comprises a screen secured around the periphery thereof to said back surface of said body and extending completely across each said vent opening.

12. An apparatus as in claim 1, wherein said front surface is decoratively contoured.

13. A shallow-profile foundation ventilator for being installed into a foundation opening, the ventilator comprising;

(a) a body;

(b) said body defining a front surface, a back surface, and at least one vent opening extending from said front surface through said body to said back surface;

(c) a screen secured around the periphery thereof to said back surface of said body and extending completely across each said vent opening;

(d) said body defining a perimeter having a top perimeter, a bottom perimeter, a right perimeter, and a left perimeter;

(e) a skirt connected to said body and engaging said entire perimeter of said body and extending in a direction generally normal to said body from said back surface of said body;

(f) at least two installation clips, each said installation clip having an installation member at one end thereof and having an opposed pair of flanges at the other end thereof, each said pair of flanges being resiliently biased toward one another, one of said clips being attached to said skirt by receiving said skirt between said metal flanges by the portion of said skirt extending from said right perimeter, at least a second of said clips being attached in a similar fashion to said skirt extending from said left perimeter;

(g) a flat cover plate dimensioned for covering each said vent opening;

(h) said cover plate defining a plurality of tear-drop shaped openings therethrough and disposed near the outer edge thereof;

(i) said body having a plurality of attachment pegs extending normally from said back surface of said body and disposed generally surrounding the portion of said body defining all of said vent openings, each said peg being disposed to coincide with one of said tear-drop openings of said cover plate; and (j) said tear-drop openings of said cover plate engaging respective coincident ones of said attachment pegs to secure said cover plate to said body and against said back surface of said body and covering all of said vent openings.

* * * * *